US008113296B2

(12) United States Patent
Shore

(10) Patent No.: US 8,113,296 B2
(45) Date of Patent: Feb. 14, 2012

(54) ANTI-ROTATION DEVICE FOR AN IMPACT TOOL

(76) Inventor: Douglas A. Shore, Quezon (PH)

( * ) Notice: Subject to any disclaimer, the term of this patent is extended or adjusted under 35 U.S.C. 154(b) by 213 days.

(21) Appl. No.: 12/430,155

(22) Filed: Apr. 27, 2009

(65) Prior Publication Data

US 2009/0266569 A1 Oct. 29, 2009

Related U.S. Application Data

(60) Provisional application No. 61/048,003, filed on Apr. 25, 2008.

(51) Int. Cl.
*B25D 17/10* (2006.01)

(52) U.S. Cl. ..... 173/132; 173/128; 173/211; 279/19.1; 279/75

(58) Field of Classification Search ..... 173/128, 173/132, 114, 168, 162.1, 211; 279/19.1, 279/75, 19.4

See application file for complete search history.

(56) References Cited

U.S. PATENT DOCUMENTS

| | | | | | |
|---|---|---|---|---|---|
| 4,072,199 | A * | 2/1978 | Wanner | 173/131 |
| 4,174,113 | A * | 11/1979 | Eckman | 279/19.4 |
| 4,648,609 | A * | 3/1987 | Deike | 279/19.1 |
| 5,110,145 | A * | 5/1992 | Stewart | 279/24 |
| 5,320,187 | A * | 6/1994 | Pressley et al. | 173/15 |
| 5,417,294 | A * | 5/1995 | Suher | 173/15 |
| 5,522,606 | A * | 6/1996 | Pressley et al. | 279/91 |
| 5,813,477 | A * | 9/1998 | Clay et al. | 173/1 |
| 6,000,888 | A * | 12/1999 | Hartman | 408/239 R |
| 6,053,675 | A * | 4/2000 | Holland et al. | 408/239 R |
| 6,705,409 | B2 * | 3/2004 | Paul | 173/132 |
| 6,745,850 | B2 * | 6/2004 | Hahn | 173/132 |
| 7,354,230 | B2 * | 4/2008 | Bauman | 408/239 R |

* cited by examiner

*Primary Examiner* — Scott A. Smith

(74) *Attorney, Agent, or Firm* — Ryan W. Dupuis; Kyle R. Satterthwaite; Ade & Company, Inc.

(57) ABSTRACT

An anti-rotation device resists relative rotation between a shank and a tool head within which the shank is supported in an impact tool, for example a rivet gun. The anti-rotation device includes a first anchor portion arranged to grip the shank between the mounting end and the working end of the shank and a second anchor portion arranged to grip the tool head in which the first and second anchor portions are formed integrally with one another of resilient material.

18 Claims, 4 Drawing Sheets

ANTI-ROTATION DEVICE FOR AN IMPACT TOOL

This application claims the benefit under 35 U.S.C. 119(e) of U.S. provisional application Ser. No. 61/048,003, filed Apr. 25, 2009.

FIELD OF THE INVENTION

This invention relates to an anti-rotation device for an impact tool and more particularly to a device for resisting relative rotation between a rivet snap and a tool head of an impact rivet gun.

BACKGROUND

A rivet is a type of fastener which generally includes a shank and a manufactured head formed at one end of the shank. When securing the rivet on a workpiece, a shop head is formed on the shank opposite the manufactured head for securing the workpiece between the heads formed on the rivet.

An impact gun or rivet gun is a known tool used for forming the shop head of a rivet. The rivet gun uses air pressure to drive a piston and a tool head connected thereto for impacting the rivet with a rivet snap secured in the tool head. In the riveting operation, a hardened steel bar or bucking bar is placed against the rivet shank to counter the pressure applied by the rivet gun on the manufactured head, thus forming the shop head.

The accessibility of the rivets to be installed however is not always ideal and thus rivet snaps are available in various sizes, shapes and lengths. Known variations of rivet snaps include offset, double offset and gooseneck types which are particularly useful when the rivet must be impacted at an angle of attack which is other than directly above and inline with the rivet. Each of these rivet snaps typically includes one or more bends in a shank of the rivet snap such that fixing the orientation of the rivet snap within the rivet gun is critical for engaging the rivet at the required angle of attack for urging the rivet against the bucking bar.

A problem with offset type rivet snaps arises when the rivet snaps rotate within the tool head of the rivet gun so as to interfere with the angle of attack of the rivet snap on the rivet. The misaligned rivet snap impacts the rivet improperly so as to damage and mar either the rivet, the workpiece or both. The damage to the rivet or workpiece can weaken the fastening strength of the rivet and the strength of the workpiece itself. Furthermore, marring removes the protective coating on the rivet and/or the workpiece, thus increasing the chance of early corrosion.

Rivet snaps are commonly secured within the tool head of the rivet gun using a spring retainer. The spring retainer however is only intended to retain the rivet snap within the tool head and does not resist the rotation of the rivet snap within the tool head which is known to occur.

To resist rotation of the rivet snap, an operator of the rivet gun is frequently required to hold the snap while riveting, however the operator is thus left without a free hand to manipulate the rivet gun or the workpiece while riveting as is often required. Rivet gun operators are thus known to place masking tape or other suitable material about a chamfered portion of the rivet snap which is arranged to be received within the tool head of the rivet gun. The use of tape increases the dimension of the rivet snap for increasing the friction of the rivet snap engaged within the tool head. Masking tape however requires frequent replacement which is time consuming and messy due to the adhesive of the tape.

SUMMARY OF THE INVENTION

According to one aspect of the present invention there is provided, in an impact tool comprising an elongate shank extending in a longitudinal direction between a working end arranged to engage a workpiece and a mounting end opposite the working end, and a tool head arranged for supporting the mounting end of the shank, the tool head being arranged to drive the shank in the longitudinal direction for impacting the workpiece, an improvement comprising an anti-rotation device for resisting relative rotation between the shank and the tool head, the anti-rotation device comprising:

a first anchor portion arranged to grip the shank between the mounting end and the working end of the shank such that relative rotation between the first anchor portion and the shank is resisted; and a second anchor portion arranged to grip the tool head such that relative rotation between the second anchor portion and the tool head is resisted;

the first and second anchor portions being coupled such that relative rotation between the first and second anchor portions is resisted.

The anti-rotation device is well suited for resisting relative rotation between a shank and a tool head of an impact gun. This is particularly useful when the impact gun comprises a rivet gun and the shank comprises an offset type rivet snap. Resisting relative rotation between the rivet snap and the rivet gun using the anti-rotation device coupled therebetween prevents misalignment of the rivet snaps with rivets in a workpiece for preventing undesirable damage to the rivet and the workpiece. Forming the anti-rotation device to comprise a body of resilient material ensures that the anti-rotation device does not interfere with the impacting motion of the shank relative to the tool head of the impact tool.

The first anchor portion preferably comprises a collar formed of resilient material arranged to be secured about the shank for gripping the shank.

An interior diameter of the collar of resilient material in a relaxed position is preferably smaller than an outer diameter of the shank such that the collar is in a stretched position when mounted about the shank for gripping the shank.

There may also be provided a clamping member arranged to be secured about the collar.

In the illustrated embodiment, the collar includes a band of increased dimension about an outer end of the collar opposite the second anchor portion with the clamp being receivable about the collar between the band and the second anchor portion.

The second anchor portion preferably comprises a sleeve arranged to extend over the tool head and grip the tool head such that relative rotation between the sleeve and the tool head is resisted.

The sleeve is preferably also formed of resilient material.

When the tool head of the impact tool includes a retainer comprising a first portion mounted about the tool head and a second portion extending about the shank spaced outwardly from the tool head so as to be arranged to limit displacement of the shank in the longitudinal direction of the shank relative to the tool head and when the shank of the impact tool includes an annular rib about the shank which is arranged to be received between the tool head and the second portion of the retainer, preferably the second anchor portion is arranged to grip the retainer and resist relative rotation between the second anchor portion and the retainer.

When the second anchor portion comprises a sleeve formed of resilient material arranged to extend over the first portion of the retainer and grip the retainer such that relative rotation between the sleeve and the tool head is resisted, preferably an interior diameter of the sleeve of resilient material in a relaxed position is smaller than an outer diameter of the retainer such that the sleeve is in a stretched position when mounted about the retainer for gripping the retainer.

When the first anchor portion comprises a collar formed of resilient material and the second anchor portion comprises a sleeve formed of resilient material, the first and second anchor portions are preferably formed integrally with one another.

There may be provided a frustoconical portion coupling the first anchor portion and the second anchor portion in which the frustoconical portion is formed of resilient material integrally with the collar and the sleeve of the first anchor portion and the second anchor portion respectively.

When the tool head of the impact tool comprises external thread formations thereon which are arranged to threadably receive a retainer thereon in which the retainer is arranged to be coupled between the shank and the tool head to limit displacement of the shank in the longitudinal direction of the shank relative to the tool head, the second anchor portion may include an integral retainer member about which the second anchor portion is integrally formed in which the integral retainer member is arranged to be threadably received directly on the external thread formations on the tool head.

According to another aspect of the invention there is provided a method of operating an impact tool comprising an elongate shank extending in a longitudinal direction between a working end arranged to engage a workpiece and a mounting end opposite the working end, and a tool head arranged for supporting the mounting end of the shank, the tool head being arranged to drive the shank in the longitudinal direction for impacting the workpiece, the method comprising:

resisting relative rotation between the shank and the tool head.

Preferably the method includes providing an anti-rotation device and resisting relative rotation between the shank and the tool head by coupling the anti-rotation device non-rotatably between the shank and the tool head.

When the shank has an annular rib about the shank externally from the tool head, the method preferably includes coupling the anti-rotation device about the shank at a location positioned outwardly beyond the annular rib relative to the tool head towards the working end of the shank.

The anti-rotation device preferably has a body of resilient material arranged to grip the shank and the tool head. The method preferably includes providing an aperture in the body of resilient material arranged to receive the shank therethrough and stretching the body of resilient material about the shank as the shank is inserted through the aperture in the body of resilient material.

A clamp member may also be provided on the anti-rotation device for clamping the clamp member about the shank with the body of resilient material being clamped between the clamp member and the shank.

The method preferably also includes stretching the body of resilient material about the first portion of the retainer.

The anti-rotation device is preferably coupled to the shank between the second portion of the retainer and the working end of the shank.

When there is provided a tool head having a retainer comprising a first portion mounted about the tool head and a second portion extending about the shank spaced outwardly from the tool head so as to be arranged to limit displacement of the shank in the longitudinal direction of the shank relative to the tool head, the method may includes replacing the retainer with the anti-rotation device and securing the anti-rotation device directly about the tool head. This can be accomplished by providing a sleeve portion on the anti-rotation device having an inner surface arranged to be threaded onto the tool head and by threading anti-rotation device onto the tool head in place of the retainer.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
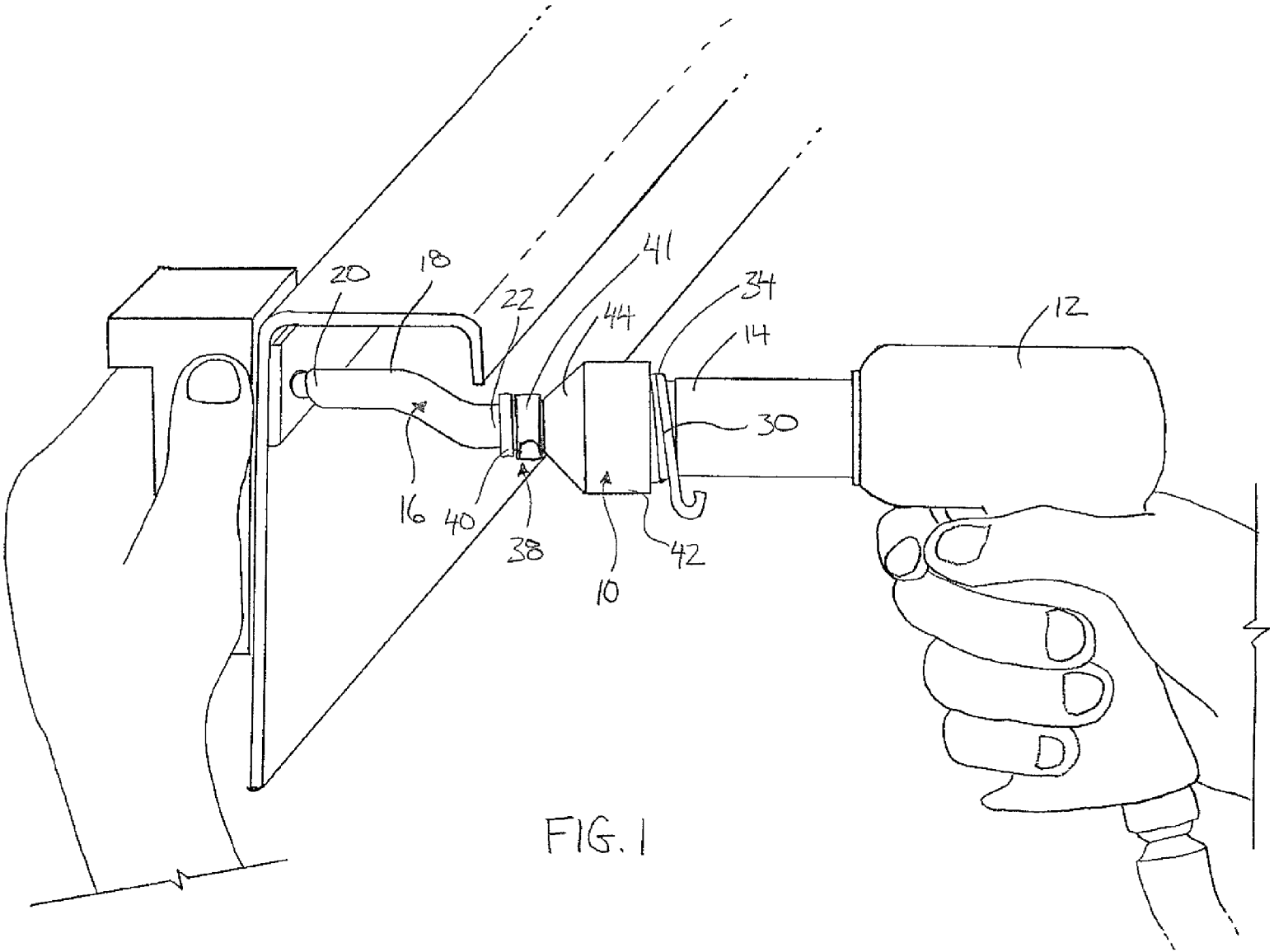
FIG. 1 is a side elevational view of an impact tool with a double offset rivet snap mounted in fixed orientation about the longitudinal axis relative to the tool head by the anti-rotation device.

Referring to the accompanying drawings, there is illustrated an anti-rotation device generally indicated by reference numeral 10. The anti-rotation device 10 is intended for use with an impact tool 12, for example an impact rivet gun of the type having a tool head 14 for receiving a rivet snap 16 therein.

Figure 4:
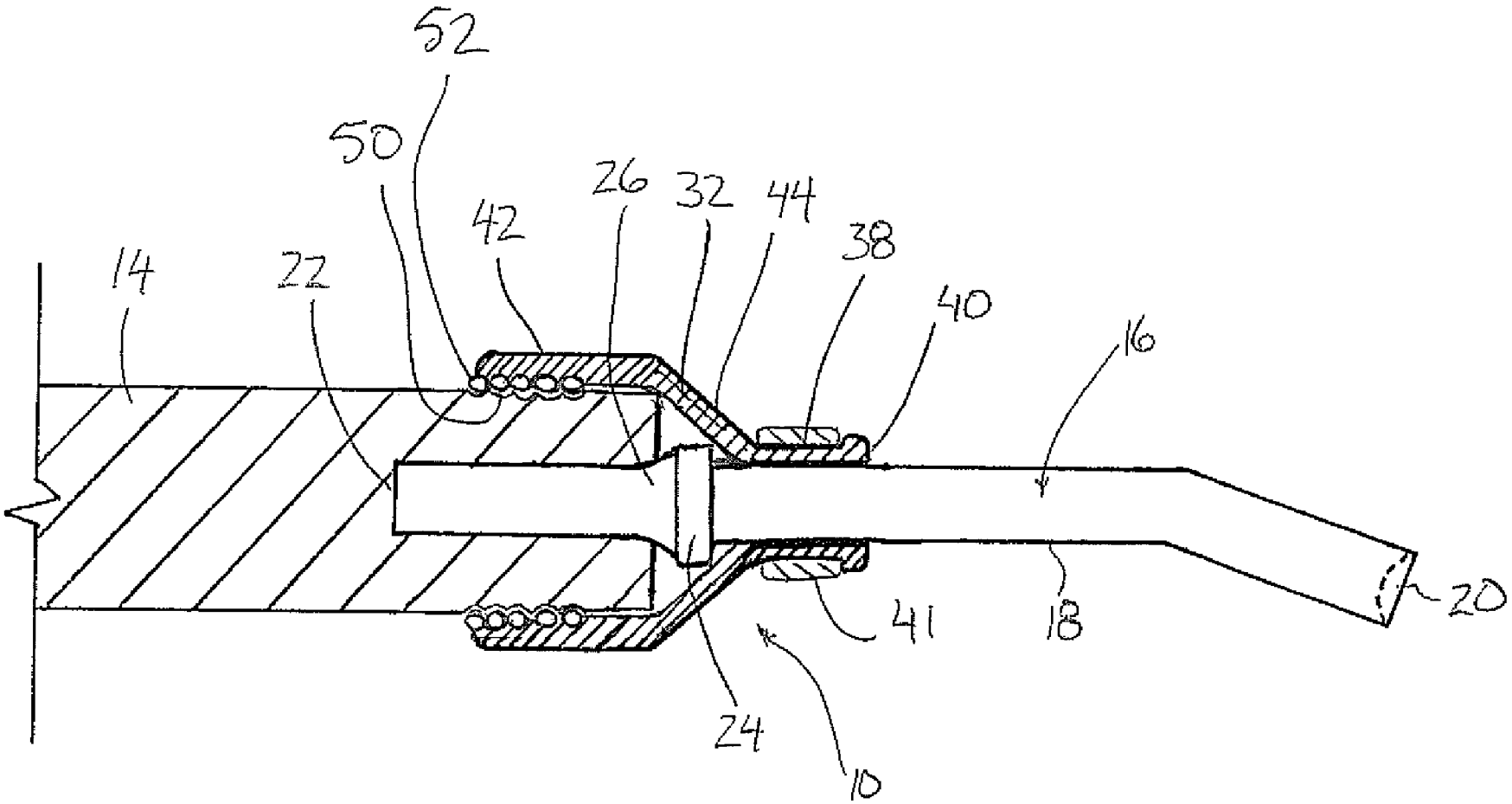
FIG. 4 is a partly sectional side elevational view of an alternative embodiment of the anti-rotation device.

The rivet snap generally comprises an elongate shank 18 which extends from a working end 20 adapted to engage a rivet to a mounting end 22 supported in the tool head 14. The rivet snaps 16 are conventional tools which come in various styles such as an offset rivet snap as shown in FIG. 4 or a double offset snap as shown in FIG. 1. Typically these rivet snaps have an outer diameter which is approximately half of an inch.

An annular rib 24 is located about the shank 18 and forms a chamfered portion 26 of the shank adjacent the mounting end thereof. The tool head 14 includes a bore 28 therein which is arranged to receive the chamfered portion 26 of the rivet snap therein. The tool head is arranged to drive the shank in a longitudinal direction of the tool head and of the shank for impacting the working end of the shank with a rivet in a workpiece.

A spring retainer 30 is provided in the form of a coil of wire similar to conventional retainers for use with impact guns. The spring retainer includes a frustoconical portion 32 which is arranged to engage about the annular rib 24 of the rivet snap and which tapers towards an outer end portion 35 secured about the shank between the annular rib or flange 24 of the shank and the working end of the shank. The retainer further comprises a cylindrical portion 34 which extends co-axially from the base of the frustoconical portion 32 opposite the outer end portion 35.

The tool head includes external thread formations about an external surface of the tool head onto which the cylindrical first portion 34 of the spring retainer can be threaded. The cylindrical portion 34 is threaded onto the tool head with sufficient tension to resist relative rotation therebetween while the frustoconical portion 32 retains the rivet snap within the tool head to restrict relative longitudinal displacement therebetween and to limit the displacement of the shank in the longitudinal direction relative to the tool head. The cylindrical portion 34 has an outer diameter which is typically in the order of one and a half inches.

Figure 2:
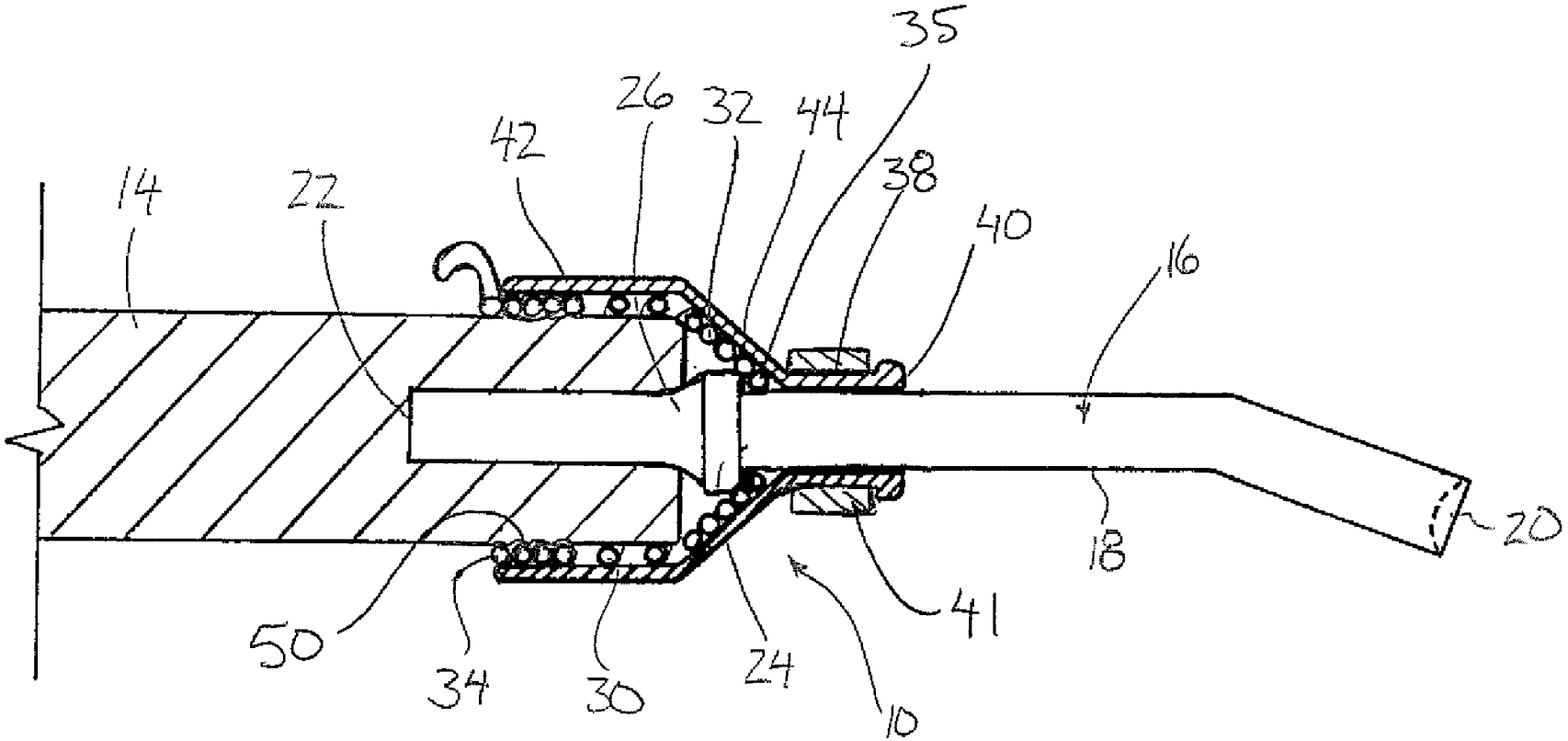
FIG. 2 is a partly sectional side elevational view of the anti-rotation device according to FIG. 1 with an offset rivet snap secured therein.
Figure 3:
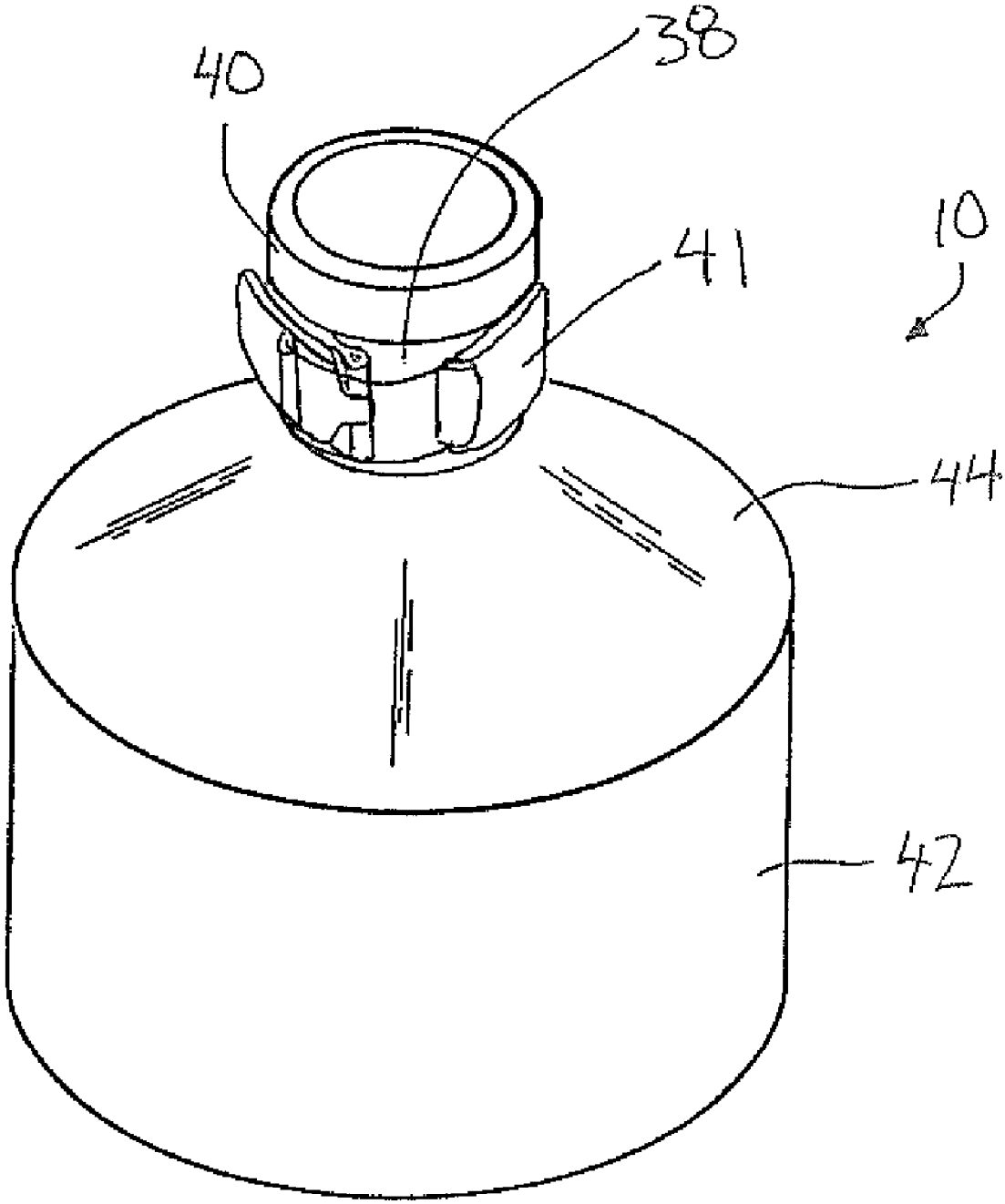
FIG. 3 is a perspective view of the anti-rotation device according to FIG. 1.

Referring initially to FIGS. 1 through 3, the anti-rotation device 10 comprises a body of resilient material in which a first anchor portion 38, a second anchor portion 42 and an intermediate frustoconical portion 44 joining the first and second anchor portions which are all integrally formed with one another of a common resilient material arranged to non-rotatably grip the retainer on the tool head and the shank of the rivet snap to resist relative rotation about the longitudinal axis of the shank.

More particularly, the body of the device 10 includes a first anchor portion 38 in the form of a collar which is arranged to be engaged about the shank 18 of the rivet snap between respective ends thereof such that relative rotation therebetween is restricted. The collar is arranged to be engaged about the shank, between the outer end portion 35 of the spring retainer adjacent the annular rib on the shank and the working end of the shank. The collar is thus positioned outwardly beyond the annular rib relative to the tool head towards the working end of the shank.

The collar is formed of a resilient plastic or rubber material so as to grip the shank and so as to permit the collar to be stretched about the shank to increase elastic tension of the collar about the shank as the shank is inserted through the aperture in the body defined by the collar.

An outer end 40 of the collar includes a band of thicker material so as to increase the elastic tension of the collar about the shank at the outer end of the collar. An inner diameter of the collar in a relaxed position is smaller than the outer diameter of the shank such that the collar must be expanded into a stretched position when mounted on the shank. For example an inner diameter of 0.395 inches is appropriate for gripping the shank.

To further secure the first anchor portion about the shank, a clamp member 41 is provided about the collar forming the first anchor portion of the body of the device 10. The clamp member in the illustrated embodiment comprises an annular clamp member having an over-centre actuating lever for displacing the clamp member between a clamped position secured tightly about the shank with the resilient material of the first anchor portion secured between the shank and the first anchor portion and a released position in which the clamp member is radially expanded relative to the clamped position to release the first anchor portion from the shank. The clamp member is received about the first anchor portion between the intermediate frustoconical portion of the body of the device and the outer end 40 of the collar. The increased thickness of material at the outer end forms an annular ridge which retains the collar about the first anchor portion.

The body of the anti-rotation device 10 comprises a second anchor portion 42 in the form of a sleeve which is arranged to extend over and about the cylindrical portion of the spring retainer 30 about the tool head such that relative rotation therebetween is resisted. The sleeve 42 is formed of the same resilient material as the collar to permit the sleeve to be similarly stretched over the spring retainer 30 on the tool head as the device is mounted onto the tool head.

An inner diameter of the sleeve in a relaxed position is less than the outer diameter of the spring retainer 30 such that the sleeve is required to be stretched over the spring retainer for increased grip. An inner diameter of 1.27 inches for example is suitable for the sleeve 42.

The intermediate frustoconical portion 44 of the anti-rotation device 10 connects the sleeve 42 with the collar 38. The frustoconical portion 44 is arranged to conform to the shape of the spring retainer 30 while mounting the collar 38 on the sleeve 42 co-axially and longitudinally spaced therefrom. The frustoconical portion 44 is formed continuously with the collar 38 and the sleeve 42 such that the anti-rotation device 10 is formed of a continuous piece of resilient material.

In use, according to the first embodiment of the anti-rotation device 10, the device is stretched over a rivet snap which has been mounted in the tool head of an impact rivet gun in a conventional manner using a spring retainer 30. The collar 38 is first stretched over the working end of the rivet snap to permit the device to be slid longitudinally along the shank of the rivet snap until the sleeve 42 can be stretched over the retainer spring 30 into an assembled position as illustrated in FIG. 1. The resilient nature of the material of which the device 10 is formed restricts relative rotation between the first anchor portion and the shank of the rivet snap and between the second anchor portion and the tool head such that the rivet snap remains properly aligned with the rivet in use by prevention relative rotation between the shank of the rivet snap and the tool head of the impact tool about a longitudinal axis of the shank.

Turning now to FIG. 4, a further embodiment of the anti-rotation device 10 is illustrated. In the embodiment of FIG. 4, the device 10 is substantially identical to the device of the previous embodiment with regard to the configuration of the first anchor 38 and the clamp member 41 secured thereabout on the shank between the annular rib and the working end of the shank. The embodiment of FIG. 4 differs from previous the previous embodiment however in that the second anchor portion 42 is instead arranged to be mounted directly onto the threaded formations 50 on the tool head in place of the spring retainer 30 which is no longer required.

More particularly the second anchor portion 42 comprises a plurality of internal thread members 52 which are similar in diameter to the cylindrical portion of the retainer normally mounted on the tool head and which are oriented in a similar helical and cylindrical pattern for threading directly onto the threaded formations similar to the mounting of a conventional spring retainer on the tool head. The second anchor portion 42 of the second embodiment again comprises a sleeve of resilient material formed integrally with the intermediate portion 44 and the first anchor portion 38. The sleeve in this instance however is integrally molded about the threaded members 52 so that the threaded members 52 and the resilient body of the device 10 form a single integral member mounted directly onto the tool head such that the first anchor portion abuts against the annular rib 24 on the shank.

The anti-rotation device 10 thus serves to limit displacement of the shank in the longitudinal direction thereof relative to the tool head without an additional retainer being required. The sleeve is again formed of resilient material and serves to provide some tension about the threaded members 52 formed integrally on the inner surface of the sleeve for constricting and gripping the threaded members 52 onto the threaded formations on the tool head so as to resist relative rotation therebetween.

Similar to the previous embodiment, the intermediate portion 44 is formed integrally of common material between the first and second anchor portions so as to be generally frustoconical in shape tapering in diameter from the larger diameter of the sleeve of the second anchor portion inwardly to the lower diameter of the collar forming the first anchor portion about the shank.

In use, the user selects an offset rivet snap which is desired to be used and inserts the mounting end thereof in the bore formed in the tool head until the chamfered portion of the annular rib is in close proximity to the outer end of the tool head. With the clamp 41 in the released position the working end of the shank is inserted through the aperture defined by the collar forming the first anchor portion such that the collar is stretched about the shank and slid along the length of the shank until it substantially abuts the annular rib on the shank.

In order to locate the first anchor portion adjacent the rib, the treaded members 52 of the second anchor portion are threaded onto the external thread formations 50 on the outer surface of the tool head. When the threaded members are fully rotated onto the threaded formations, the first anchor portion abuts the outer side of the annular rib. The shank of the rivet snap is then manually rotated about the longitudinal axis thereof until the working end is in the desired orientation. The clamp member can then be constricted into its clamped position about the collar of the first anchor portion such that the first anchor portion is tightly fixed about the shank to resist any relative rotation therebetween.

With the resilient nature of the sleeve of the second anchor portion secured about the thread members 52, relative rotation about the longitudinal axis of the tool head and the shank is restricted between the second anchor portion and the tool head while the clamp member ensures that relative rotation between the first anchor portion and the shank is resisted. By integrally joining the first and second anchor portions with one another by the intermediate portion 44 connected therebetween the shank is prevented from rotation relative to the tool head. The resilient nature of the intermediate portion ensures that the anti-rotation device does not interfere with impacting motion of the rivet snap relative to the impact tool.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. In an impact tool comprising an elongate shank extending in a longitudinal direction between a working end arranged to engage a workpiece and a mounting end opposite the working end, and a tool head arranged for supporting the mounting end of the shank, the tool head being arranged to drive the shank in the longitudinal direction for impacting the workpiece, an improvement comprising an anti-rotation device for resisting relative rotation between the shank and the tool head, the anti-rotation device comprising:

a first anchor portion arranged to grip the shank between the mounting end and the working end of the shank such that relative rotation between the first anchor portion and the shank is resisted;

a second anchor portion arranged to grip the tool head such that relative rotation between the second anchor portion and the tool head is resisted; and an intermediate portion coupling the first and second anchor portions such that relative rotation between the first and second anchor portions is resisted;

wherein the intermediate portion is sufficiently resilient that longitudinal impacting motion of the shank relative to the tool head is substantially unrestricted while the first anchor portion non-rotatably grips the shank and the second anchor portion non-rotatably grips the tool head.

2. The improvement according to claim 1 wherein the first anchor portion comprises a collar formed of resilient material arranged to be secured about the shank for gripping the shank.

3. The improvement according to claim 2 wherein an interior diameter of the collar of resilient material in a relaxed position is smaller than an outer diameter of the shank such that the collar is in a stretched position when mounted about the shank for gripping the shank.

4. The improvement according to claim 2 wherein there is provided a clamping member arranged to be secured about the collar.

5. The improvement according to claim 4 wherein the collar includes a band of increased dimension about an outer end of the collar opposite the second anchor portion, the clamp being receivable about the collar between the band and the second anchor portion.

6. The improvement according to claim 1 wherein the second anchor portion comprises a sleeve arranged to extend over the tool head and grip the tool head such that relative rotation between the sleeve and the tool head is resisted.

7. The improvement according to claim 6 wherein the sleeve is formed of resilient material.

8. The improvement according to claim 7 wherein the tool head of the impact tool includes a retainer comprising a first portion mounted about the tool head and a second portion extending about the shank spaced outwardly from the tool head so as to be arranged to limit displacement of the shank in the longitudinal direction of the shank relative to the tool head, the improvement comprising the second anchor portion being arranged to grip the retainer and resist relative rotation between the second anchor portion and the retainer.

9. The improvement according to claim 8 wherein the second anchor portion comprises a sleeve formed of resilient material arranged to extend over the first portion of the retainer and grip the retainer such that relative rotation between the sleeve and the tool head is resisted.

10. The improvement according to claim 9 wherein an interior diameter of the sleeve of resilient material in a relaxed position is smaller than an outer diameter of the retainer such that the sleeve is in a stretched position when mounted about the retainer for gripping the retainer.

11. The improvement according to claim 1 wherein the first anchor portion comprises a collar formed of resilient material and the second anchor portion comprises a sleeve formed of resilient material, the first and second anchor portions being formed integrally with one another.

12. The improvement according to claim 11 wherein the intermediate portion comprises a frustoconical portion coupling the first anchor portion and the second anchor portion, the frustoconical portion being formed of resilient material integrally with the collar and the sleeve of the first anchor portion and the second anchor portion respectively.

13. The improvement according to claim 1 wherein the first anchor portion comprises a clamp member arranged to be selectively clamped about the shank.

14. The improvement according to claim 1 wherein the tool head of the impact tool comprises external thread formations thereon which are arranged to threadably receive a retainer thereon in which the retainer is arranged to be coupled between the shank and the tool head to limit displacement of the shank in the longitudinal direction of the shank relative to the tool head, the improvement comprising the second anchor portion including an integral retainer member about which the second anchor portion is integrally formed, the integral retainer member being arranged to be threadably received directly on the external thread formations on the tool head.

15. In an impact tool comprising an elongate shank extending in a longitudinal direction between a working end arranged to engage a workpiece and a mounting end opposite the working end, and a tool head arranged for supporting the mounting end of the shank, the tool head being arranged to drive the shank in the longitudinal direction for impacting the workpiece, the tool head of the impact tool including a retainer comprising a first portion mounted about the tool head and a second portion extending about the shank spaced outwardly from the tool head so as to be arranged to limit displacement of the shank in the longitudinal direction of the shank relative to the tool head, and the shank of the impact tool including an annular rib about the shank which is arranged to be received between the tool head and the second portion of the retainer, an improvement comprising an anti-rotation device arranged for resisting relative rotation between the shank and the tool head, the anti-rotation device comprising:

a first anchor portion arranged to grip the shank between the mounting end and the working end of the shank such that relative rotation between the first anchor portion and the shank is resisted; and a second anchor portion arranged to grip the retainer of the tool head such that relative rotation between the second anchor portion and the retainer of the tool head is resisted;

the first and second anchor portions being coupled such that relative rotation between the first and second anchor portions is resisted.

16. The improvement according to claim 15 wherein the second anchor portion comprises a sleeve formed of resilient material arranged to extend over the first portion of the retainer and grip the retainer such that relative rotation between the sleeve and the tool head is resisted.

17. The improvement according to claim 15 wherein an interior diameter of the sleeve of resilient material in a relaxed position is smaller than an outer diameter of the retainer such that the sleeve is in a stretched position when mounted about the retainer for gripping the retainer.

18. In an impact tool comprising an elongate shank extending in a longitudinal direction between a working end arranged to engage a workpiece and a mounting end opposite the working end, and a tool head arranged for supporting the mounting end of the shank, the tool head being arranged to drive the shank in the longitudinal direction for impacting the workpiece, the tool head further comprising external thread formations thereon which are arranged to threadably receive a retainer thereon in which the retainer is arranged to be coupled between the shank and the tool head to limit displacement of the shank in the longitudinal direction of the shank relative to the tool head, an improvement comprising an anti-rotation device for resisting relative rotation between the shank and the tool head, the anti-rotation device comprising:

a first anchor portion arranged to grip the shank between the mounting end and the working end of the shank such that relative rotation between the first anchor portion and the shank is resisted; and a second anchor portion arranged to grip the tool head such that relative rotation between the second anchor portion and the tool head is resisted;

the second anchor portion including an integral retainer member about which the second anchor portion is integrally formed in which the integral retainer member is arranged to be threadably received directly on the external thread formations on the tool head; and the first and second anchor portions being coupled such that relative rotation between the first and second anchor portions is resisted.

* * * * *